US007578088B2

(12) United States Patent
Alves

(10) Patent No.: US 7,578,088 B2
(45) Date of Patent: Aug. 25, 2009

(54) TAG HOLDER PROFILE OR A MOTHER PROFILE FOR FASTENING A REMOVABLE TAG HOLDER

(75) Inventor: Manuel Alves, Tortosendo (PT)

(73) Assignee: Joalpe Industria De Expositores, S.A., Tortosendo (PT)

( * ) Notice: Subject to any disclaimer, the term of this patent is extended or adjusted under 35 U.S.C. 154(b) by 12 days.

(21) Appl. No.: 11/775,392

(22) Filed: Jul. 10, 2007

(65) Prior Publication Data

US 2008/0022574 A1 Jan. 31, 2008

(51) Int. Cl.

| | |
|---|---|
| ***G09F 3/18*** | (2006.01) |
| ***G09F 7/00*** | (2006.01) |
| ***A47B 96/06*** | (2006.01) |
| ***A47F 5/08*** | (2006.01) |

(52) U.S. Cl. ..... 40/661.03; 40/661; 40/611.06; 40/642.02; 248/220.21; 248/220.22; 211/57.1

(58) Field of Classification Search ..... 40/661.03, 40/661, 661.06, 642.02; 211/57.1; 248/220.22, 248/220.21

See application file for complete search history.

(56) References Cited

U.S. PATENT DOCUMENTS

| | | | | |
|---|---|---|---|---|
| 5,572,822 | A * | 11/1996 | Lynch et al. | 40/642.02 |
| 6,105,295 | A | 8/2000 | Brinkman et al. | |
| 6,665,971 | B2 * | 12/2003 | Lowry et al. | 40/661 |
| 2002/0146282 | A1 | 10/2002 | Wilkes et al. | |
| 2003/0146357 | A1 * | 8/2003 | Bjerke et al. | 248/220.22 |
| 2004/0098897 | A1 | 5/2004 | Thompson | |

FOREIGN PATENT DOCUMENTS

| | | |
|---|---|---|
| FR | 2850198 | 7/2004 |

* cited by examiner

*Primary Examiner*—Lesley D. Morris
*Assistant Examiner*—Syed A Islam
(74) *Attorney, Agent, or Firm*—Egbert Law Offices PLLC

(57) ABSTRACT

The invention relates to a tag holder profile or mother profile for fastening a removable tag holder, intended for equipping a shelf or the like, in particular shelving. The profile has a rear fastening section on the front edge of the shelf or the like. According to the invention, the profile includes a longitudinal housing on an upper portion of the profile, able to open upwards, and at least one lid slaved to the remainder of the body of the profile. The lid is capable of covering the housing.

1 Claim, 2 Drawing Sheets

TAG HOLDER PROFILE OR A MOTHER PROFILE FOR FASTENING A REMOVABLE TAG HOLDER

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The invention relates to a tag holder profile or a mother profile for fastening a removable tag holder, intended for equipping a shelf or the like, in particular shelving.

The invention will find a particular application in all the fields of economic activity where it is desirable to display information on shelving or shelves.

2. Description of Related Art Including Information Disclosed Under 37 CFR 1.97 and 37 CFR 1.98

In the field of information display, in particular for the display of price tags, it is known to use plastic tag holder profiles or mother profiles for fastening a tag holder.

Both these types of profiles are fastened to the front edge of a shelf, via a rear fastening section. The tag holder profile is generally a single-piece, obtained by the extrusion processes and may in particular exhibit a clear pocket wherein are inserted the tags to be displayed.

The mother profiles, for their own part, act as supports for fastening a removable tag holder. As known, the tag holder can be fixed to the mother profile by a snapping system. The tag holder may exhibit a clear pocket for the reception of a price tag and may protrude downwards beneath the mother profile. A jointing zone can be provided on the upper section of the tag holder to enable forward and upward tilting of the tag holder relative to the mother profile, in particular when an item is withdrawn from a lower shelving.

It should be noted that the mother profile may alternately allow to support and attach electronic price tags.

In the field of information display, accessories for easier arrangement as well as more efficient hold of the articles on the shelving surface are also known.

These accessories may in particular be in the form of partition walls, arranged perpendicular to the longitudinal axis of the shelving surface in order to separate and hold two rows of articles.

These accessories may also be in the form of a back rest such as a back rest sliding on a running track, enabling to hold a row of articles arranged vertically. The sliding back rest can be actuated forwards by means of a spring-loaded system or still via a pull cord to enable to feed the row of articles as it becomes empty.

As known, these accessories exhibit on a front section a jaw provided for engaging, in particular pinching, an assembly rail, in particular of T-section shape. This assembly rail, in particular of T-section shape, may be formed on an upper portion of a mother profile, or of a tag holder profile at a wing covering a front zone of the shelving surface.

However, according to the shelving configurations, a profile without any accessories may be provided. In the latter case, the assembly rail, in particular of T-section shape, is not applicable. It protrudes upon the shelving surface and degrades the visual aspect of the latter.

Besides, in the field of information display, it is also known to locate a façade on the front of the shelving. These façades are in particular formed by an L-section profile, whereof the vertical wing forms a resting foot bearing on a front zone at the surface of the shelving. This façade profile also protrudes on the façade of a shelving.

Besides, the mother profiles or still the tag holder profiles should be designed without any cavities or concave sections, which are permanent, thereby liable to provide dust catchers.

BRIEF SUMMARY OF THE INVENTION

The purpose of this invention is to remedy the shortcomings afore-mentioned while offering a mother profile for fastening a removable tag holder or still a tag holder profile solving, all or some of the shortcomings afore-mentioned, in particular without providing a dust catcher.

An object of the invention is in particular to offer a profile enabling easy and quick assembly of a façade or the like.

Another aim of the invention is in particular to offer a multipurpose profile enabling to co-operate or not with presentation accessories, without however degrading the visual aspect of the shelving.

Other aims and advantages of the invention will appear in the following description which is given only by way of example and without being limited thereto.

The invention relates to a tag holder profile or mother profile for fastening a removable tag holder, intended for equipping a shelf or the like, in particular shelving. The profile exhibits a rear fastening section on the front edge of the shelf or the like, characterized in that the profile exhibits moreover, a longitudinal housing on an upper portion of the profile, opening upwards, as well as at least one lid slaved to the remainder of the body of the profile, and capable of covering said housing.

According to a variation, the housing exhibits a groove to enable assembly of a façade, a pediment or a railing capable of preventing articles from falling.

According to another variation, the lid is in the form of an assembly rail for fastening presentation accessories on the shelf.

The invention also relates to a method for the manufacture of such a profile, a method wherein the profile is extruded from at least one plastic material.

BRIEF DESCRIPTION OF THE SEVERAL VIEWS OF THE DRAWINGS

The invention will be understood better when reading the following description accompanied by the appended drawings, which are integral part thereof.

DETAILED DESCRIPTION OF THE INVENTION

Figure 1:
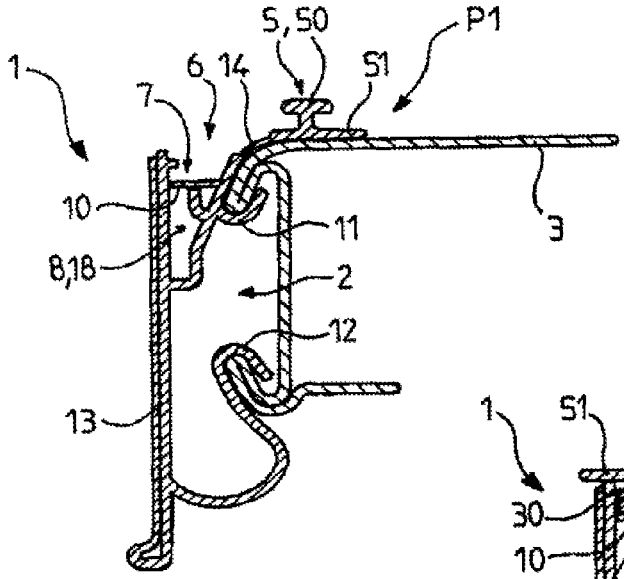
FIG. 1 is a sectional view of a tag holder profile according to the invention in an embodiment, the lid forming an extended assembly rail bearing upon the presentation surface.

The invention relates first of all to a tag holder profile 1 or mother profile for fastening a removable tag holder, intended for equipping a shelf or the like, in particular shelving.

The profile exhibits a rear fastening section 2 on the front edge of the shelf 3 or the like.

According to the invention, the profile 1 exhibits moreover, a longitudinal housing 6 on an upper portion of the profile, opening upwards, as well as at least one lid 5 slaved to the remainder of the body of the profile 1, and capable of covering said housing 6.

Figure 3:
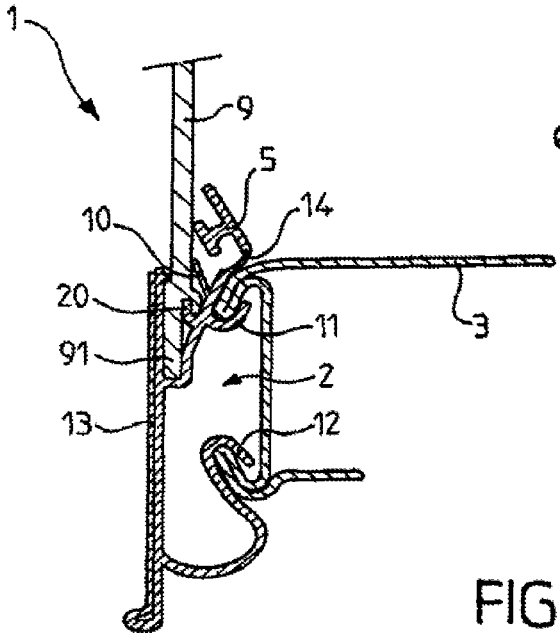
FIG. 3 is a sectional view of the profile as illustrated on FIG. 1, a façade being nested into the housing.

According to an embodiment, said housing 6 exhibits a groove 18 to enable assembly of a façade 9, of a pediment or still of a railing capable of preventing articles from falling, as illustrated on FIG. 3.

In particular, the element to be assembled, i.e. the façade, the pediment, the railing, or the like, may exhibit a nestable foot 91 designed for insertion in the groove 18.

The profile may moreover exhibit an end portion 20 delineating one of the upper edges of the groove 18.

This end portion 20 may engage inside a grooved cavity of the nestable foot 91.

According to an embodiment, the lid 5 may be in the form of an assembly rail 50, in particular of T-section shape, for fastening presentation accessories on the shelf, such as in particular partition walls.

The assembly rail 50 is joined to the remainder of the body of the profile 1 to allow at least one first position P1, so-called operating position, wherein the assembly rail 5 rests on the shelf, toward at least one second position P2, so-called retracted position, wherein the assembly rail 6 is seating in said housing 6, while covering the latter.

In particular, the assembly rail 50, in particular of T-section shape, exhibits a planar base 51 capable of covering the housing 6.

Figure 2:
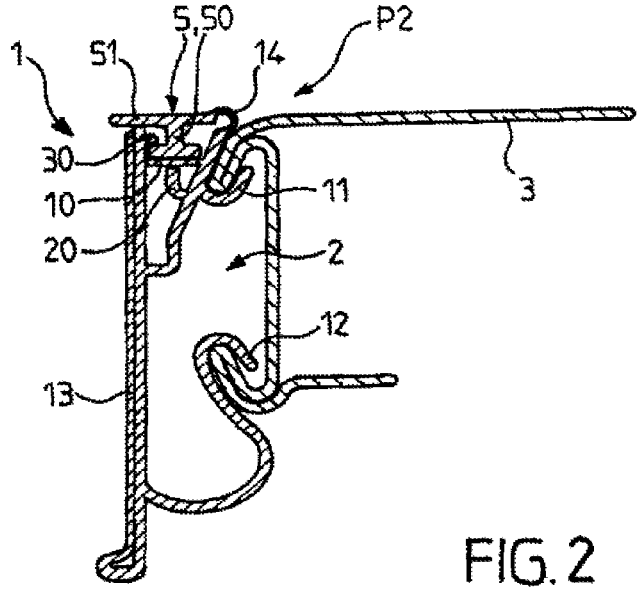
FIG. 2 is a sectional view of the profile as illustrated on FIG. 1, the assembly rail being retracted in the longitudinal housing of the profile.

Advantageously, as illustrated on FIGS. 1 to 3, the profile 1 may exhibit simultaneously a groove 18, enabling the assembly of a façade or the like, and a retractable assembly rail 50.

In particular, the housing 6 may exhibit an upper portion 7 intended for cooperating with the assembly rail 5 and a lower portion 8 forming said groove 18 for assembling, by nesting, the façade, the pediment, the railing or the like.

Advantageously, the housing 6 may exhibit a double bottom, the upper portion 7 and the lower portion 8 of the housing 6 being separated by a second lid, in particular formed by a flexible tab 10, capable of covering the lower portion 8 of said housing 6.

It will be noted that this flexible tab 10 can be raised, as illustrated on FIG. 3, to enable insertion of the nestable foot 91 of the façade 9 or the like. It will also be noted that said end portion 20 forms a stop for the flexible tab 10, prohibiting the displacement thereof in the lower portion 8 of the housing.

According to an embodiment, said at least one lid 5 may be joined to the remainder of the profile by means of a zone of flexible material 14, in particular made of plastic material. However, the joint is not limited to this embodiment and could be provided by a hinge or the like.

As illustrated according to an embodiment, the rear fastening section 2 is formed of a jumper for attachment to an edge rail, situated, directly or indirectly on the front edge of the shelf. The jumper exhibits in particular end interlocking means 11, 12 capable of cooperating at least at one corresponding lateral end of the edge rail.

However, a rear fastening section is not limited to that embodiment and the profile could be installed to the shelf by any other means, in particular by means of adhesives, fastening members, or the like.

According to the embodiment illustrated on FIGS. 1 to 3, the profile is a tag holder profile. It exhibits in particular a clear front pocket 13, for retaining a tag or the like. This pocket is in particular formed of two thin plates pressure-held against one another and slaved at a lower folding area. The upper end of the thin plate arranged internally forms in particular, at least partially, a wall for the housing 6.

As illustrated, a locking finger 30 is in particular provided on the internal wall of the housing 6, and is capable of locking the position of the assembly rail, in particular of T-section shape, at the horizontal wing or still capable of locking the position of the nestable foot 91 of the façade or the like, at a shoulder.

Figure 4:
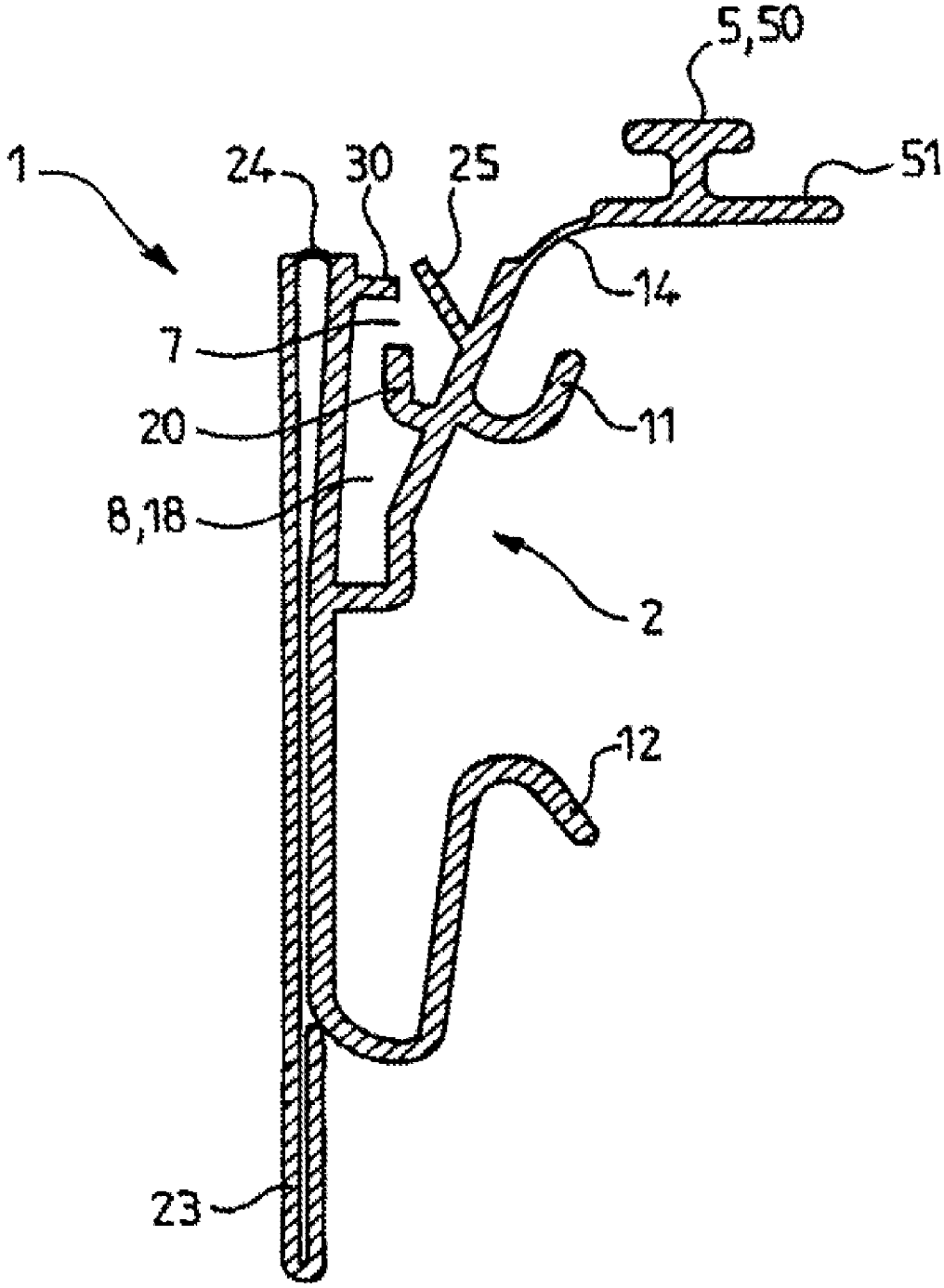
FIG. 4 is a sectional view of a tag holder profile according to the invention in a second embodiment, in particular fitted with a tilting tag holder pocket.

The profile illustrated on FIG. 4 is a tag holder profile. It differs from the profile of FIGS. 1 to 3 in that it exhibits a tiltable front pocket 23.

Once the profile has been mounted on the tray of a shelf, the front pocket 23 protrudes beneath the tray. The pocket 23 is jointed to the remainder of the profile by means of a zone of flexible material 24.

The profile of FIG. 4 exhibits, moreover, a pinching tab 25. This tab 25 differs from the tab 10 of the profile of FIG. 1 in that it enables to pinch the assembly rail 50, in particular the horizontal wing below the locking finger 30. Conversely, the tab 25 does not enable to cover the lower portion 8 of the housing 6.

In a non-illustrated embodiment, the profile forms a mother profile for fastening a removable tag holder. The mother profile exhibits in particular an assembly zone for fastening, by snapping, of at least one tag holder.

The invention also relates to a method for the manufacture of such a profile 1, said profile exhibiting a rear fastening section 2 on the front edge of the shelf 3 or the like, the profile 1 exhibiting, moreover, a longitudinal housing 6 on an upper portion of the profile, open upwards, as well as at least one lid 5 slaved to the remainder of the body of the profile 1, and capable of covering said housing 6. According to this method, the profile is extruded from at least one plastic material.

According to an embodiment, the profile exhibits a lid 5 joined to the remainder of the profile 1 by means of a zone of flexible material. According to this embodiment of the method, the profile is co-extruded from at least two plastic materials, the zone of flexible material 14 of the profile being extruded from of a first plastic material, exhibiting characteristics considered as soft or flexible, the remainder of the profile being extruded from a second plastic material exhibiting characteristics considered as rigid or semi-rigid.

Naturally, other embodiments, understandable to the man of the art, could have been contemplated without departing from the framework of the invention.

I claim:

1. A tag holder profile for fastening a removable tag holder to a shelf, the tag holder profile comprising:

a rear fastening section suitable for placement on a front edge of the shelf;

a longitudinal housing connected to said rear fastening section, said longitudinal housing having a groove formed therein so as to open upwardly, said groove having a size suitable for receiving a facade therein; and a lid interconnected to said rear fastening section, said lid movable between a first position away from said groove and a second position covering said groove, said lid having a T-shaped assembly rail thereon, said first position suitable for resting on the shelf, said second position being seated in said longitudinal housing, said longitudinal housing having an upper portion cooperative with said assembly rail and a lower portion defining said groove, said longitudinal housing having a double bottom, said upper portion and said lower portion being separated by another lid, said another lid formed by a flexible tab, said another lid movable so as to cover said lower portion of said longitudinal housing.

* * * * *